US012228144B2

(12) United States Patent
Wei et al.

(10) Patent No.: US 12,228,144 B2
(45) Date of Patent: Feb. 18, 2025

(54) FAN ASSEMBLY AND AIR CONDITIONER

(71) Applicants: GD MIDEA HEATING & VENTILATING EQUIPMENT CO., LTD., Foshan (CN); HEFEI MIDEA HEATING & VENTILATING EQUIPMENT CO., LTD., Hefei (CN)

(72) Inventors: Fuquan Wei, Foshan (CN); Yandong Wu, Foshan (CN); Lihua Ma, Foshan (CN)

(73) Assignees: GD MIDEA HEATING & VENTILATING EQUIPMENT CO., LTD., Foshan (CN); HEFEI MIDEA HEATING & VENTILATING EQUIPMENT CO., LTD., Hefei (CN)

( * ) Notice: Subject to any disclaimer, the term of this patent is extended or adjusted under 35 U.S.C. 154(b) by 0 days.

(21) Appl. No.: 18/564,013

(22) PCT Filed: Apr. 28, 2022

(86) PCT No.: PCT/CN2022/089939
§ 371 (c)(1),
(2) Date: Nov. 24, 2023

(87) PCT Pub. No.: WO2023/279817
PCT Pub. Date: Jan. 12, 2023

(65) Prior Publication Data

US 2024/0301893 A1 Sep. 12, 2024

(30) Foreign Application Priority Data

Jul. 7, 2021 (CN) ..... 202121538970.9

(51) Int. Cl.
*F04D 17/16* (2006.01)
*F04D 29/42* (2006.01)
(Continued)

(52) U.S. Cl.
CPC ..... *F04D 29/4233* (2013.01); *F04D 17/16* (2013.01); *F04D 29/422* (2013.01); *F04D 29/441* (2013.01); *F04D 29/667* (2013.01)

(58) Field of Classification Search
CPC ..... F04D 29/4226; F04D 29/441; F04D 29/667; F04D 17/04; F04D 29/428; F04D 29/4206
See application file for complete search history.

(56) References Cited

U.S. PATENT DOCUMENTS 9,624,932 B2 * 4/2017 Jeon ..... F24F 1/0022
11,193,499 B2 * 12/2021 Pirouzpanah ..... F04D 17/08
(Continued)

FOREIGN PATENT DOCUMENTS

CN 101131163 A 2/2008
CN 102518603 A 6/2012
(Continued)

OTHER PUBLICATIONS

The World Intellectual Property Organization (WIPO) International Search Report for PCT/CN2022/089939 Jun. 16, 2022 7 pages (including English translation).
(Continued)

*Primary Examiner* — Eldon T Brockman
(74) *Attorney, Agent, or Firm* — Anova Law Group, PLLC

(57) ABSTRACT

A fan assembly includes a volute and a fan wheel. The volute includes a volute body and a volute tongue connected at an opening of the volute body. The fan wheel is arranged at least partially in the volute body. The volute tongue includes a flow diffusion portion and a flow-passing part. The flow-passing part is located at two sides of the flow diffusion part in an axial direction of the fan wheel. The flow-passing part is located at a higher position than the flow diffusion part.

20 Claims, 7 Drawing Sheets

(51) Int. Cl.
*F04D 29/44* (2006.01)
*F04D 29/66* (2006.01)

(56) References Cited

U.S. PATENT DOCUMENTS

| | | | | |
|---|---|---|---|---|
| 11,506,222 | B2 * | 11/2022 | Luo | F04D 29/422 |
| 2010/0040456 | A1 | 2/2010 | Hwang et al. | |
| 2014/0286800 | A1 * | 9/2014 | Jeon | F04D 29/283 415/203 |
| 2019/0186499 | A1 | 6/2019 | Pirouzpanah et al. | |

FOREIGN PATENT DOCUMENTS

| | | | | |
|---|---|---|---|---|
| CN | 103512064 | A | | 1/2014 |
| CN | 210196137 | U | * | 3/2020 |
| CN | 210565177 | U | | 5/2020 |
| CN | 215490035 | U | | 1/2022 |
| EP | 3705729 | A1 | | 9/2020 |
| JP | S5489510 | U | | 6/1979 |
| JP | S6314020 | A | | 1/1988 |
| JP | 2005037001 | A | | 2/2005 |
| JP | 2007010240 | A | | 1/2007 |
| JP | 2008089205 | A | | 4/2008 |
| JP | 2009270778 | A | | 11/2009 |
| WO | 2019087298 | A1 | | 5/2019 |

OTHER PUBLICATIONS

The European Patent Office (EPO) The Extended European Search Report for Application No. 22836576.3 Oct. 8, 2024 11 Pages.

The Japan Patent Office (JPO) Notice of Reasons for Refusal for Application No. 2023-572945 Oct. 1, 2024 26 Pages (including translation).

The Australian National Intellectual Property Office The Examination report No. 1 for Application No. 2022308067 Nov. 29, 2024 4 Pages.

* cited by examiner

FAN ASSEMBLY AND AIR CONDITIONER

CROSS-REFERENCE TO RELATED APPLICATIONS

This application is a National Stage Entry under 35 U.S.C. § 371 of International Application No. PCT/CN2022/089939, filed on Apr. 28, 2022, which claims priority to Chinese patent application Ser. No. 202121538970.9, titled "FAN ASSEMBLY AND AIR CONDITIONER," and filed with China National Intellectual Property Administration on Jul. 7, 2021, the entire contents of both of which are incorporated herein by reference.

FIELD

The present disclosure relates to the field of fan technologies, and more particularly, to a fan assembly and an air conditioner.

BACKGROUND

A fan assembly is a core component of an air conditioner, and the performance of the fan assembly determines the size, performance, and sound quality of the air conditioner. In the related art, the fan assembly has different air outflowing speeds at the air outlet (the flow speed in the middle is larger than the flow speed in the periphery). This causes the fan assembly and the air conditioner to have a high noise level and affects the air supply efficiency of the fan.

SUMMARY

The present disclosure aims to solve at least one of the technical problems in the related art.

To this end, a first aspect of the present disclosure provides a fan assembly.

A second aspect of the present disclosure provides an air conditioner.

The first aspect of the present disclosure provides the fan assembly. The fan assembly includes a volute and a fan wheel. The volute includes a volute body and a volute tongue connected at an opening of the volute body, and the fan wheel is arranged at least partially in the volute body. The volute tongue includes a flow diffusion part and a flow-passing part. The flow-passing part is located at two sides of the flow diffusion part in an axial direction of the fan wheel and located at a higher position than the flow diffusion part.

The fan assembly of the present disclosure includes the volute and the fan wheel. The volute includes the volute body and the volute tongue connected at the opening of the volute body. The fan wheel is arranged at least partially in the volute body. During an operation of the fan assembly, the fan wheel rotates to suction an airflow from the outside into the volute body, and the airflow is discharged after being pressurized by the fan wheel and flowing through the volute tongue.

In some embodiments, during the operation of the fan assembly, the distribution of the airflow flowing out from the fan wheel is not uniform. In the axial direction of the fan wheel, a portion closer to the middle has a relatively high air volume, and the portion having the relatively high air volume has a correspondingly faster air flow speed. Therefore, the present disclosure optimizes a shape of the volute tongue. The volute tongue includes the flow diffusion part and the flow-passing part, and ensures that the flow-passing part is located at the higher position than the flow diffusion part, enabling that a relative position of the flow diffusion part is lower. In this way, the position where the flow-passing part is located has a flow-passing area that can be effectively enlarged, which in turn reduces a flow speed of the airflow at this position, enabling an overall flow speed of the fan assembly to be relatively more uniform.

In addition, in the axial direction of the fan wheel, the flow-passing part is located at the two sides of the flow diffusion part, which enables that the flow diffusion part is located at a middle position. In this way, the distribution of the flow diffusion part and the flow-passing part is configured to match the distribution of the air volume of the airflow flowing out from the fan wheel. The flow diffusion part is located at a lower level than the flow-passing part, which allows that the flow diffusion part can be configured to increase the flow-passing area at the position where the flow diffusion part is located, thereby decreasing the air flow speed at the position where the flow diffusion part is located. In this way, uniformity of the airflow from the fan assembly is ensured by cooperation between the flow-passing part and the flow diffusion part.

Therefore, in the case of the same operating sound, the fan assembly of the present disclosure is able to supply a relatively large air volume to satisfy air adjustment in a relatively large space. Accordingly, under the same air volume, the fan assembly of the present disclosure has a relatively low operating sound, and improves the comfort of the fan assembly. Accordingly, in the case of the same air volume and the same operating sound, the fan assembly of the present disclosure has a relatively small volume, which can meet a lower cost or adapt to more diversified mounting space requirements.

Therefore, the present disclosure optimizes the shape of the volute, and the volute tongue includes the flow-passing part and flow diffusion part in conjunction with each other, which reduces the flow speed at a position where the flow-passing part is located, ensures the uniformity of the airflow from the fan assembly, and effectively improves the operating performance of the fan assembly.

The fan assembly according to the above technical solution of the present disclosure may further have following additional features.

In the above technical solution, the volute tongue further includes a tongue body. The flow diffusion part and the flow-passing part are disposed at the tongue body, and the flow diffusion part is recessed relative to the tongue body.

In some possible solutions, in the axial direction of the fan wheel, a middle portion of the flow diffusion part has a depth greater than a depth of each of two side portions of the flow diffusion part.

In some possible solutions, a cross section of the flow diffusion part in the axial direction of the fan wheel includes one arc or a plurality of arcs connected to one another.

In some possible solutions, for the cross section of the flow diffusion part in the axial direction of the fan wheel, a height of the flow diffusion part increases synchronously from the middle portion of the flow diffusion part to the two ends of the flow diffusion part.

In some possible solutions, a height of the flow diffusion part gradually increases in an air outflowing direction of the volute.

In some possible solutions, a cross section of the flow diffusion part in a radial direction of the fan wheel includes a straight line, and a first angle between the straight line and a horizontal plane is greater than 8° and smaller than or equal to 12°.

In some possible solutions, a cross section of the flow diffusion part in a radial direction of the fan wheel includes an arc, and a second angle between a tangent line of the arc at an end close to the fan wheel and the horizontal plane is greater than 8° and smaller than or equal to 12°.

In some possible solutions, the flow diffusion part is connected to an inner wall of the volute body in a radial direction of the fan wheel.

In some possible solutions, a rounded corner is formed between the flow diffusion part and an inner wall of the volute body in a radial direction of the fan wheel.

In some possible solutions, a ratio of a maximum depth of the flow diffusion part to an axial dimension of the volute tongue is greater than or equal to 0.05 and smaller than or equal to 0.1.

In some possible solutions, the volute tongue further includes a sinking platform, and the sinking platform is disposed at the flow-passing part and located at the two sides of the flow diffusion part.

In some possible solutions, the volute has air inlets located at two sides of the fan wheel in the axial direction of the fan wheel. The fan assembly further includes a flow collector disposed at the air inlet of the volute.

In some possible solutions, the volute includes a first housing and a second housing connected to each other. The first housing is provided with the flow diffusion part and the flow-passing part.

The second aspect of the present disclosure provides the air conditioner including the fan assembly of any one of the above technical solutions.

The air conditioner of the present disclosure includes the fan assembly of any one of the above technical solutions. Therefore, the air conditioner has all beneficial effects of the fan assembly of the above technical solutions, which will not be described in detail herein.

Additional aspects and advantages of the present disclosure will be given at least partially in the following description, become apparent at least partially from the following description, or can be learned from practicing of the present disclosure.

BRIEF DESCRIPTION OF THE DRAWINGS

The above and/or additional aspects and advantages of the present disclosure will become apparent and readily understood from the description of embodiments in conjunction with following accompanying drawings.

In FIG. 1 to FIG. 7, the correspondence between reference numbers and terms of components is as follows:

102 volute; 104 volute body; 106 tongue body; 108 flow diffusion part; 110 flow-passing part; 112 volute tongue; 114 sinking platform; 116 flow collector; 118 first housing; 120, second housing; 122 air inlet; 124 air outlet.

DETAILED DESCRIPTION

In order to enable clearer understanding of the above objects, features, and advantages of the present disclosure, detailed description of the present disclosure will be given below in conjunction with the accompanying drawings and specific embodiments. It should be noted that embodiments in the present disclosure and features of the embodiments can be combined with one another without conflict.

In the following description, many specific details are provided to facilitate full understanding of the present disclosure. However, the present disclosure may be implemented in many different forms, and is not limited to the embodiments described herein. Therefore, the scope of the present disclosure is not limited by specific embodiments disclosed below.

A fan assembly and an air conditioner according to some embodiments of the present disclosure are described below with reference to FIG. 1 to FIG. 7. A dashed arrow in FIG. 3 indicates an air outflowing direction of a volute 102. A dotted line L1 in FIG. 2 and FIG. 4 indicates a reference plane L1. A straight line L2 in FIG. 7 indicates a horizontal plane. A direction of a dotted line O in FIG. 4 is an axial direction of a fan wheel.

Figure 1:
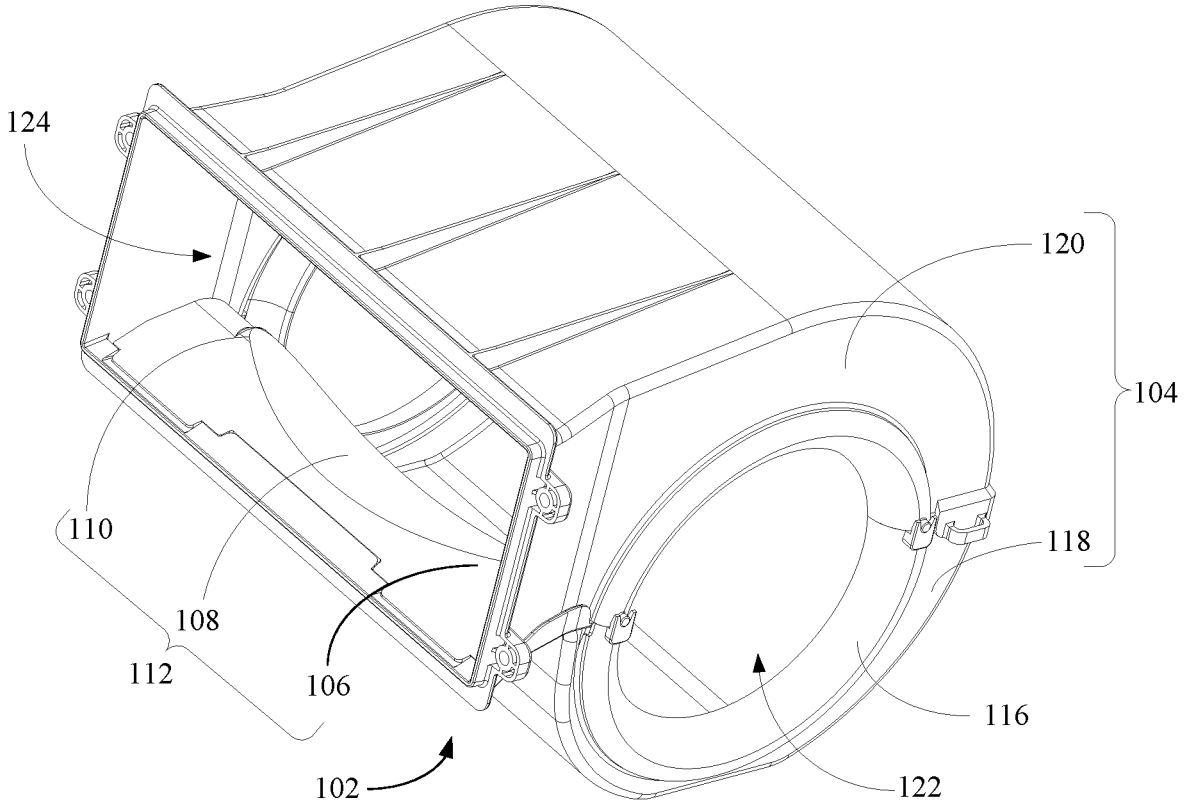
FIG. 1 is a schematic structural view of a fan assembly (a fan wheel is hidden) according to an embodiment of the present disclosure.
Figure 2:
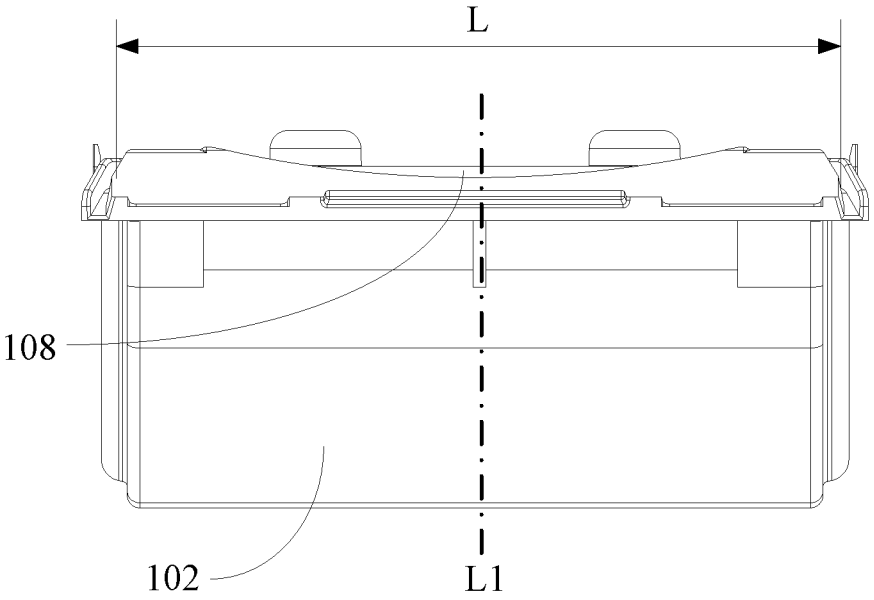
FIG. 2 is a side view of the fan assembly shown in FIG. 1.
Figure 3:
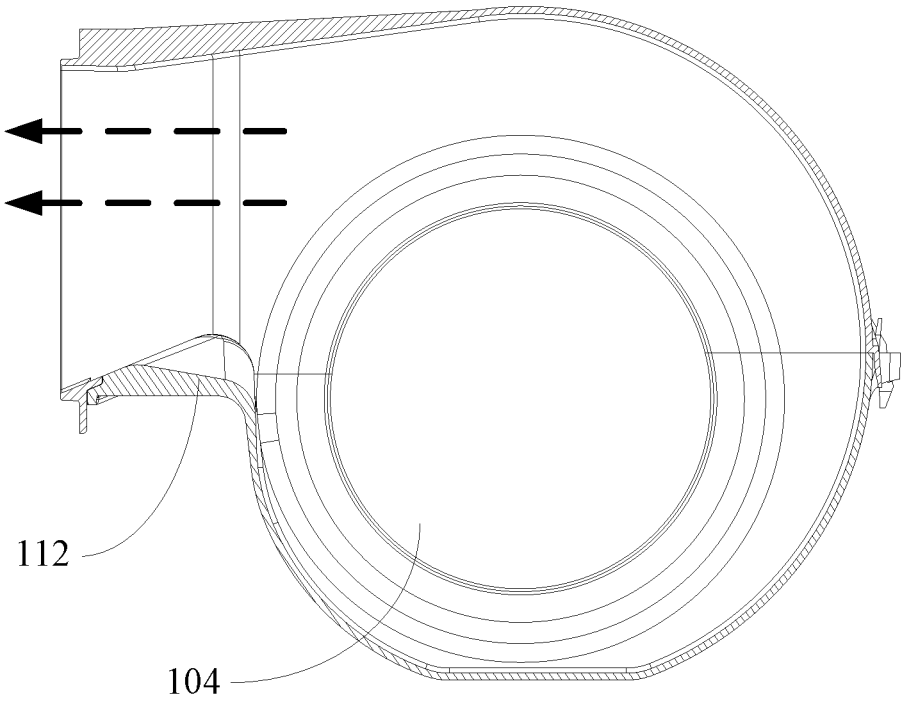
FIG. 3 is a sectional view of the fan assembly shown in FIG. 1.
Figure 4:
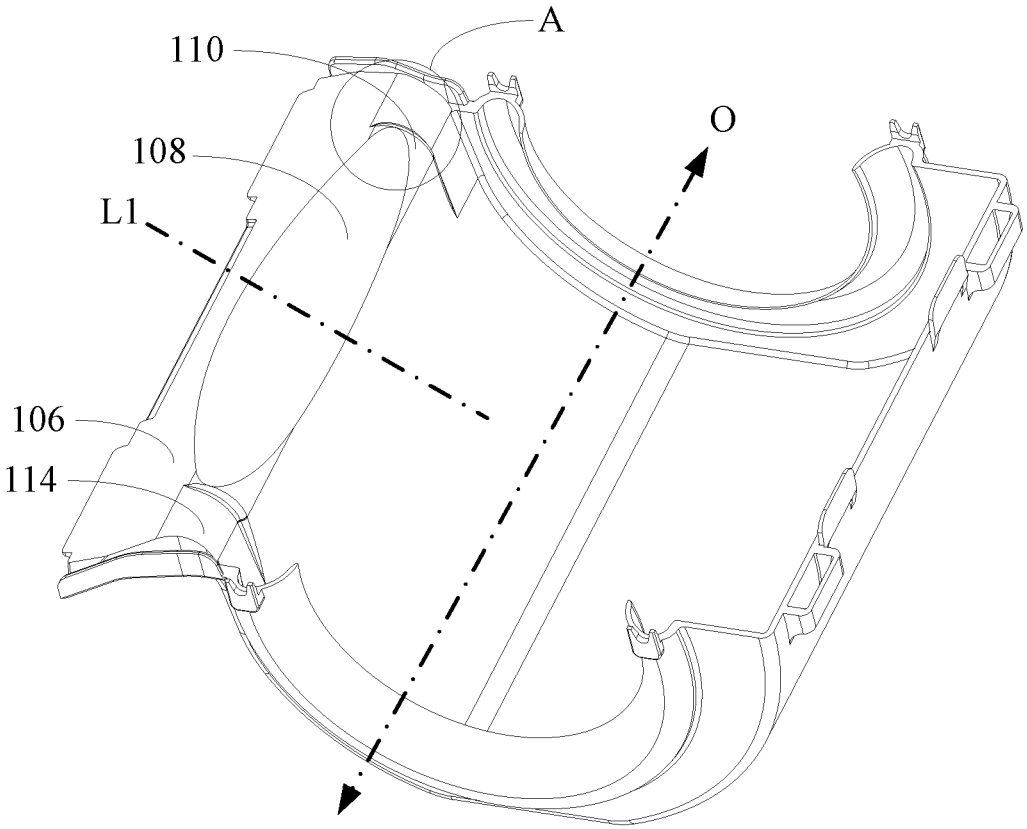
FIG. 4 is a schematic structural view of a first housing in the fan assembly shown in FIG. 1.

As shown in FIG. 1, FIG. 2 and FIG. 3, a first embodiment of the present disclosure provides the fan assembly. The assembly includes the volute 102 and the fan wheel (not shown in the drawings).

As shown in FIG. 3, the volute 102 includes a volute body 104 and a volute tongue 112 connected at an opening of the volute body 104. The fan wheel is disposed at least partially in the volute body 104. During an operation of the fan assembly, the fan wheel rotates to suction an airflow from the outside into the volute body 104, and the airflow is discharged through the opening after being pressurized by the fan wheel.

Figure 5:
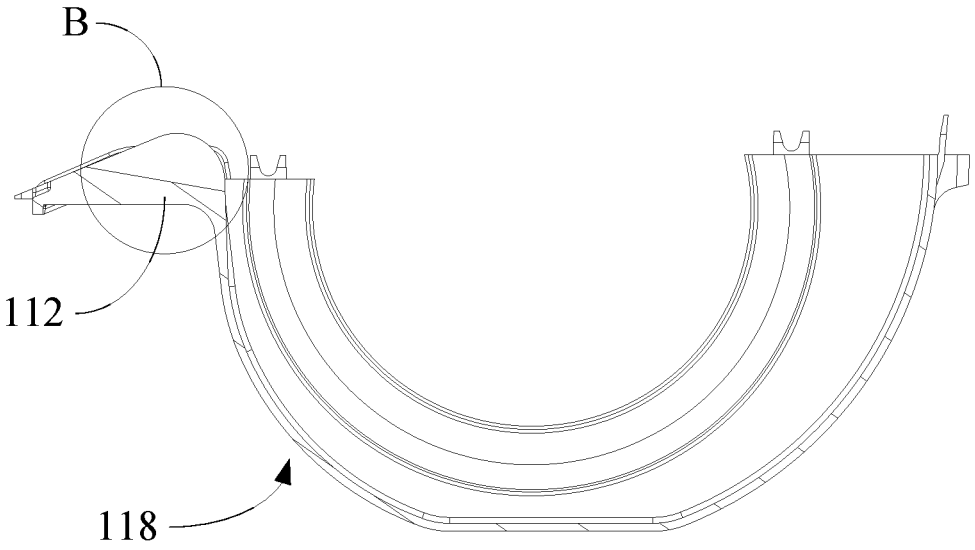
FIG. 5 is a side view of the first housing shown in FIG. 4.
Figure 6:
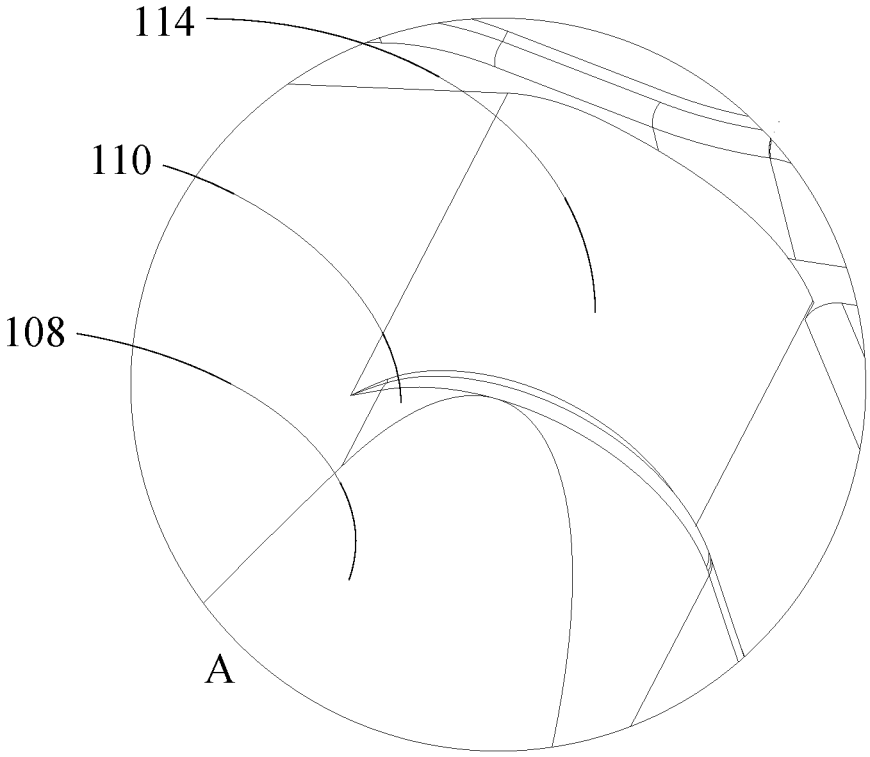
FIG. 6 is an enlarged view of a part A of the first housing shown in FIG. 4.

In some embodiments, during the operation of the fan assembly, the distribution of the airflow flowing out from the fan wheel is not uniform. In the axial direction of the fan wheel, a portion closer to the middle has a relatively high air volume, and the portion having the relatively high air volume has a correspondingly faster air flow speed. Accordingly, as shown in FIG. 4, FIG. 5 and FIG. 6, this embodiment optimizes a shape of the volute 102. The volute tongue 112 includes a flow diffusion part 110 and a flow-passing part 108 in cooperation with each other, and ensures that the flow-passing part 110 is located at a higher position than the flow diffusion part 118, enabling that a relative position of the flow diffusion part 118 is relatively low. In this way, a flow-passing area of the flow-passing part 110 at a position where the flow-passing part 110 is located at the volute tongue 112 can be effectively enlarged, which in turn reduces a flow speed of the airflow at the position where the flow-passing part 110 is located, allowing an overall flow speed of the fan assembly to be relatively more uniform.

Further, as shown in FIG. 4, FIG. 5 and FIG. 6, in the axial direction of the fan wheel, the flow-passing part 110 is located at two sides of the flow diffusion part 108, and the flow diffusion part 108 is located at the middle. In this way, the arrangement of the flow diffusion part 108 and the flow-passing part 110 is configured to match the distribution of an air volume of the airflow flowing out from the fan wheel. The flow diffusion part 108 is located at a lower level than the flow-passing part 110, which allows that the flow diffusion part 108 can be configured to increase the flow-passing area at the position where the flow diffusion part 108 is located, thereby decreasing the air flow speed at the position where the flow diffusion part 108 is located. In this way, uniformity of the airflow from the fan assembly is ensured by cooperation between the flow-passing part 110 and the flow diffusion part 108.

Therefore, in the case of the same operating sound, the fan assembly of this embodiment is able to supply a relatively large air volume to satisfy air adjustment in a relatively large space. Accordingly, under the same air volume, the fan assembly of this embodiment has a relatively low operating sound, and improves the comfort of the fan assembly. Accordingly, in the case of the same air volume and the same operating sound, the fan assembly of this embodiment has a relatively small volume, which can meet a lower cost or adapt to more diversified mounting space requirements.

Therefore, this embodiment optimizes the shape of the volute 102, and the volute tongue 112 includes the flow-passing part 110 and the flow diffusion part 108 in conjunction with each other, which reduces the flow speed of the airflow at the position where the flow-passing part 110 is located, ensures the uniformity of the airflow from the fan assembly, and effectively improves operating performance of the fan assembly.

A second embodiment of the present disclosure provides a fan assembly. In view of the first embodiment, the fan assembly is further described as follows.

As shown in FIG. 4 and FIG. 6, the volute tongue 112 further includes a tongue body 106 connected at the opening of the volute body 104, and the flow diffusion part 108 and the flow-passing part 110 are disposed at the tongue body 106.

In addition, the flow-passing part 110 is flush with an inner wall of the tongue body 106. During the operation of the fan assembly, the airflow is guided and divided directly by the inner wall of the tongue body 106, which enables that the airflow pressurized by the fan wheel flows through the flow-passing part 110 and is finally discharged. In some embodiments, the inner wall of the tongue body 106 defines the flow-passing part 110 as described above.

In addition, the flow diffusion part 108 is recessed relative to the tongue body 106. In this way, the flow diffusion part 108 is ensured to be located at a lower level than the flow-passing part 110. That is, the flow-passing area at the position where the flow diffusion part 108 is located is ensured to be greater than the flow-passing area at the position where the flow-passing part 110 is located. In this way, the flow speed of the airflow at the position where the flow diffusion part 108 is located is reduced to a certain extent, and the flow speed of the airflow at the position at the position where the flow diffusion part 108 is located is consistent with the flow speed of the airflow at the position at the position where the flow-passing part 110 is located, which realizes uniform air supply of the entire fan assembly. In some embodiments, an interior of the tongue body 106 is provided with a groove, which defines the above flow diffusion part 108.

In this embodiment, the volute tongue 112 has a simple structure. A structure of the volute tongue 112 and a structure of the whole fan assembly can be simplified, and manufacture of the volute tongue 112 and manufacture of the whole fan assembly can be facilitated. Moreover, the recessed flow diffusion part 108 can further reduce a wind resistance at the position where the flow diffusion part 108 is located. In this way, a higher static pressure can be used to overcome the resistance in the volute 102 in the same air volume, while allowing more even and rational distribution of the air volume in the volute 102.

In addition, the flow diffusion part 108 may be directly connected to the volute body 104 in an air outflowing direction of the volute 102. Alternatively, a rounded corner may be formed between the flow diffusion part 108 and the volute body 104, and thus the flow diffusion part 108 and the volute body 104 are connected through the rounded corner. Each of the above two manners ensures a smooth connection between the flow diffusion part 108 and an inner wall of the volute body 104.

A third embodiment of the present disclosure provides a fan assembly. In view of the above embodiment, the fan assembly is further provided as follows.

As shown in FIG. 2 and FIG. 4, in the axial direction of the fan wheel, a middle portion of the flow diffusion part 108 has a depth greater than a depth of each of two side portions of the flow diffusion part 108. In some embodiments, a plane having the same distances from two end surfaces of the fan wheel in the axial direction is defined as a reference plane L1. In the axial direction of the fan wheel, a center of the flow diffusion part 108 is located at the reference plane L1, and the middle portion of the flow diffusion part 108 has the depth greater than the depth of each of the two side portions of the flow diffusion part 108 from the reference plane L1 to two sides of the flow diffusion part 108. In some embodiments, the depth of the flow diffusion part 108 is a recessed depth of the flow diffusion part 108.

This embodiment optimizes the depth of the flow diffusion part 108, which enables that the middle portion of the flow diffusion part 108 has the depth greater than the depth of each of the two side portions of the flow diffusion part 108 in the axial direction of the fan wheel. In this way, the depth of the flow diffusion part 108 decreases gradually from the center to the two sides in the axial direction of the fan wheel, which in turn allows a flow diffusion effect of the flow diffusion part 108 to decrease gradually in the axial direction of the fan wheel. That is, in the axial direction of the fan wheel, a flow-passing area gradually decreases from the middle portion of the flow diffusion part 108 to the two sides of the flow diffusion part 108.

In some embodiments, during the operation of the fan assembly, in the axial direction of the fan wheel, an air volume at the reference plane L1 is maximum, and an air volume gradually decreases from the reference plane L1 to the two sides of the flow diffusion part 108. Therefore, in this embodiment, the flow diffusion part 108 is disposed in the volute tongue 112, which further optimizes the depth of the flow diffusion part 108. In this way, the depth of the flow diffusion part 108 matches the air volume at the position where the flow diffusion part 108 is located, ensuring that the depth of the flow diffusion part 108 at the reference plane L1 is maximum and the depth at the two sides gradually decreases. Therefore, an airflow speed at the position where the flow diffusion part 108 is located is ensured to be uniform.

Further, in this embodiment, as shown in FIG. 4, a cross section of flow diffusion part 108 in the axial direction of the fan wheel includes one arc or a plurality of arcs connected to one another. In this way, a depth of the reference plane L1 gradually increases or decreases, which ensures that the reference plane L1 is in a smooth state in the axial direction of the fan wheel. On the one hand, an overall structure of the flow diffusion part 108 is ensured to be coordinated, and on the other hand, the flow diffusion part 108 does not generate wind resistance in the volute 102 to ensure the air supply efficiency of the fan assembly.

Furthermore, in this embodiment, as shown in FIG. 4, for the cross section of the flow diffusion part 108 in the axial direction of the fan wheel, a height of the flow diffusion part 108 increases synchronously from the middle portion of the flow diffusion part 108 to the two sides of the flow diffusion part 108. That is, a cross section of the flow diffusion part 108 in the axial direction of the fan wheel is symmetrical with respect to the reference plane L1.

In some embodiments, during the operation of the fan assembly, the airflow flowing out of the fan wheel is gradually reduced from the reference plane L1 toward two sides, and the amount of the airflow is negatively correlated with the distance from the position where it is located to the reference plane L1. Therefore, in this embodiment, the shape of the flow diffusion part 108 is optimized based on distribution regularity of the air volume, ensuring that the cross section of the flow diffusion part 108 in the axial direction of the fan wheel is symmetrical with respect to the reference plane L1. That is, the shape of the flow diffusion part 108 is ensured to match the distribution of the air volume, and the reference plane L1 is ensured to be in a smooth state in the axial direction of the fan wheel. On the one hand, the overall structure of the flow diffusion part 108 is ensured to be coordinated, and on the other hand, the flow diffusion part 108 does not generate the wind resistance in the volute 102 to ensure the air supply efficiency of the fan assembly.

A fourth embodiment of the present disclosure provides a fan assembly. In view of the second embodiment, the fan assembly is further provided as follows.

Figure 7:
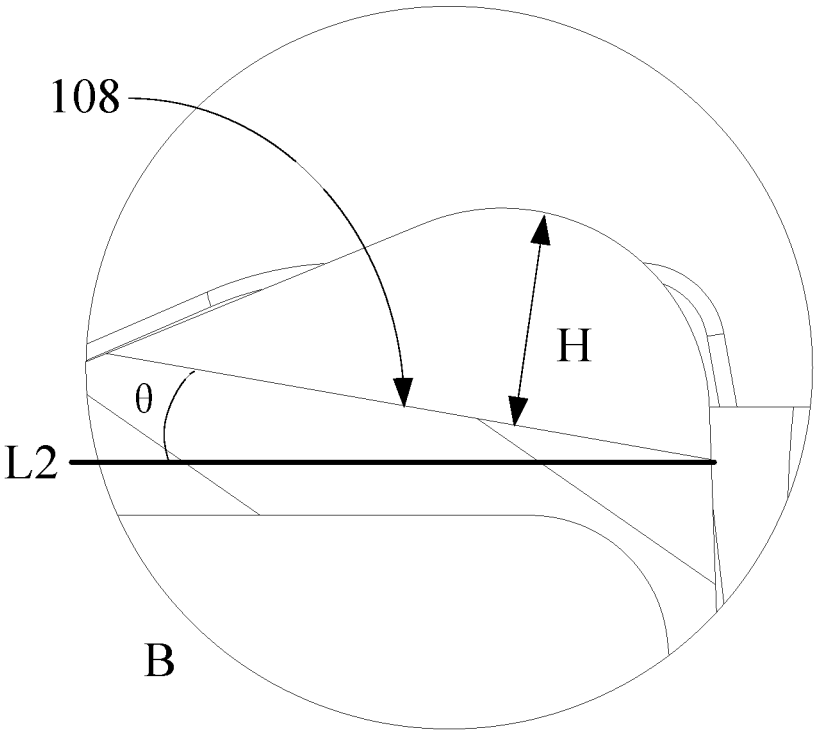
FIG. 7 is an enlarged view of a part B of the first housing shown in FIG. 5.

As shown in FIG. 5 and FIG. 7, an end of the flow diffusion part 108 connected to the inner wall of the volute body 104 is located at a lower level than another end of the flow diffusion part 108 connected to the inner wall of the tongue body 106. That is, the height of the flow diffusion part 108 gradually increases in the air outflowing direction of the volute 108.

Therefore, the height of the flow diffusion part 108 is optimized, and thus a smooth connection between the flow diffusion part 108 and the inner wall of the volute tongue 112 is ensured. In this way, during the operation of the fan assembly, the airflow flows smoothly out of the volute body 104, and is in a smooth transition state when flowing through the flow diffusion part 108.

A fifth embodiment of the present disclosure provides a fan assembly. In view of the fourth embodiment, the fan assembly is further provided as follows.

As shown in FIG. 5 and FIG. 7, after the air conditioner is mounted, an air outlet 124 of the volute 102 is horizontally disposed. A cross section of the flow diffusion part 108 in the radial direction of the fan wheel includes a straight line. In addition, a first angle θ between the straight line and a horizontal plane L2 is greater than 8° and smaller than or equal to 12°. That is, in the air outflowing direction of the volute 102, an inclination angle between a wall surface of the flow diffusion part 108 and an air supply direction is ensured to be in a range of 8° to 12°, and a side of the flow diffusion part 108 facing toward the volute body 104 is ensured to be at a lower position.

In this way, during the operation of the fan assembly, the airflow pressurized by the fan wheel firstly flows to the positions where the flow diffusion part 108 and the flow-passing part 110 are located. Since an inclination angle in a range of 8° to 12° is formed between the wall surface of the flow diffusion part 108 the horizontal plane L2, the airflow can smoothly flow to the flow diffusion part 108. In addition, since the flow diffusion part 108 is lower than flow diffusion part 108, it is ensured that the flow speed of the airflow passing through the flow diffusion part 108 is reduced and matches the flow speed of the airflow passing through the flow-passing part 110. In this way, firstly, a uniform air supply speed of the whole fan assembly can be ensured, and secondly, a smooth and efficient airflow flowing through the flow diffusion part 108 can be ensured, which reduce operating noise of the fan assembly and improve the air supply efficiency of the fan assembly.

In some embodiments, the first angle θ may be 8°, 9°, 10°, 11°, 12°, and the like, which is not specifically limited herein. The first angle can be realized as long as noise reduction and air supply efficiency improvement can be achieved, which can be understood by those skilled in the art.

A sixth embodiment of the present disclosure provides a fan assembly. In view of the fourth embodiment, the fan assembly is further provided as follows.

After the air conditioner is mounted, the air outlet 124 of the volute 102 is horizontally disposed. The cross section of the flow diffusion part 108 in the radial direction of the fan wheel includes an arc (this embodiment is not shown in the drawings). In addition, a second angle is formed between a tangent line of the arc at an end close to the fan wheel and the horizontal plane L2, and is greater than 8° and smaller than or equal to 12°. That is, in the air outflowing direction of the volute 102, an inclination angle between the wall surface of the flow diffusion part 108 and the air supply direction is ensured to be in a range of 8° to 12°, and a side of the flow diffusion part 108 facing toward the volute body 104 is ensured to be located at a lower position.

In this way, during the operation of the fan assembly, the airflow pressurized by the fan wheel firstly flows to the positions where the flow diffusion part 108 and the flow-passing part 110 are located. Since there is the inclination angle in a range of 8° to 12° between the wall surface of the flow diffusion part 108 and the horizontal plane L2, the airflow can smoothly flow to the flow diffusion part 108. In addition, since the flow diffusion part 108 is lower than flow diffusion part 108, it is ensured that the flow speed of the airflow passing through the flow diffusion part 108 is reduced and matches the flow speed of the airflow passing through the flow-passing part 110. In this way, firstly, the uniform air supply speed of the whole fan assembly can be ensured, and secondly, the smooth and efficient airflow flowing through the flow diffusion part 108 can be ensured, which reduce the operating noise of the fan assembly and improve the air supply efficiency of the fan assembly.

In some embodiments, the second angle may be 8°, 9°, 10°, 11°, 12°, and the like, which is not specifically limited herein. The second angle can be realized as long as noise reduction and air supply efficiency improvement can be achieved, which can be understood by those skilled in the art.

A seventh embodiment of the present disclosure provides a fan assembly. In view of the second embodiment, the fan assembly is further provided as follows.

As shown in FIG. 2 and FIG. 7, this embodiment optimizes a ratio between a maximum depth H of the flow diffusion part 108 and an axial dimension L of the volute tongue 112, to ensure that the ratio between the maximum depth H of the flow diffusion part 108 and the axial dimension L of the volute tongue 112 is greater than or equal to 0.05 and smaller than or equal to 0.1. In this way, a maximum recess depth of the flow diffusion part 108 in the volute tongue 112 is guaranteed to match, i.e., a maximum recess dimension of the flow diffusion part 108 in the volute tongue 112 is guaranteed to be appropriate.

In some embodiments, the maximum depth H of the flow diffusion part 108 directly affects the flow diffusion effect of the flow diffusion part 108. That is, the greater the maximum depth H of the flow diffusion part 108 is, the better the diffusion effect is at a position where the depth is the greatest, and the greater the effect on reducing the flow speed is. Therefore, in this embodiment, the ratio between the maximum depth H of the flow diffusion part 108 and the axial dimension L of the volute tongue 112 is greater than or equal to 0.05, ensuring a sufficient flow diffusion effect of the flow diffusion part 108.

In addition, if the ratio between the maximum depth H of the flow diffusion part 108 and the axial dimension L of the volute tongue 112 is too great, the flow diffusion part 108 may result in a lower strength of the whole volute tongue 112. Therefore, in this embodiment, the ratio between the maximum depth H of the flow diffusion part 108 and the axial dimension L of the volute tongue 112 is configured to be smaller than or equal to 0.1. In this way, the structure of the flow diffusion part 108 matches the structure of the volute tongue 112, ensuring the strength of the volute tongue 112 while ensuring the flow diffusion effect, and further ensuring a service life of the volute tongue 112 and a service life of the whole fan assembly.

In some embodiments, the ratio between the maximum depth H of the flow diffusion part 108 and the axial dimension L of the volute tongue 112 may be 0.05, 0.06, 0.07, 0.08, 0.09, 0.1, and the like, which is not specifically limited herein. As long as the flow diffusion part 108 has the sufficient flow diffusion effect and a relatively strong strength, which can be realized and can be understood by those skilled in the art.

An eighth embodiment of the present disclosure provides a fan assembly. In view of the second embodiment, the fan assembly is further provided as follows.

As shown in FIG. 4 and FIG. 6, the fan assembly further includes a sinking platform 114, which is disposed at the flow-passing part 110 and located at the two sides of the flow diffusion part 108. The flow-passing part 110 is provided with the sinking platform 114, which can ensure a minimum gap between the inner wall of the volute 102 and an outer edge of the fan wheel at the volute tongue 112, and can reduce impact of the airflow on the volute 102. In this way, a flow field inside the volute 102 is optimized to effectively prevent vortex from being generated by the airflow at the volute tongue 112, which effectively reduces vortex noise of the fan while ensuring the performance of the fan assembly. This in turn improves using comfort of the fan assembly and ensures the air supply efficiency of the fan assembly.

Further, in this embodiment as shown in FIG. 4 and FIG. 6, the volute tongue 112 further includes the sinking platform 114 disposed at the tongue body 106, and the flow diffusion part 108 is located between two sinking platforms 114. In other words, in this embodiment, the sinking platform 114 is provided at a position in the volute tongue 112 close to each of two sidewalls of the volute 102. The sinking platforms 114 are ensured to be respectively located at the two sides of the flow diffusion part 108, and the flow diffusion part 108 is ensured to be arranged between the two sinking platforms 114. In some embodiments, during the operation of the fan assembly, the above arrangement of the sinking platforms 114 can ensure a minimum gap between the volute tongue 112 and the outer edge of the fan wheel, and can reduce impact of the airflow on the volute 102. In this way, the flow field inside the volute 102 is optimized to effectively prevent the vortex from being generated by the airflow at the volute tongue 112, which effectively reduces the vortex noise of the fan while ensuring the performance of the fan assembly. This in turn improves using comfort of the fan assembly and ensures the air supply efficiency of the fan assembly.

In view of the first embodiment to the eighth embodiment, as shown in FIG. 1, air inlets 122 of the volute 102 is located at two sides of the fan wheel in the axial direction of the fan wheel, and the air outlet 124 of the volute 102 is located at a lateral side of the fan wheel. In this way, during the operation of the fan assembly, external air can flow into an interior of the volute 102 from the two sides of the fan wheel in the axial direction, and is discharged through the air outlet 124 located at the lateral side of the fan wheel in the axial direction of the fan wheel after being pressurized by the fan wheel.

In view of the first embodiment to the eighth embodiment, as shown in FIG. 1, the fan assembly further includes a flow collector 116. The flow collector 116 is disposed at the volute 102, and is located at the air inlet 122 of the volute 102. In this way, during the operation of the fan assembly, the flow collector 116 can achieve a good effect of collecting and guiding flow at the air inlet 122 of the volute 102, thereby improving the air supply volume and the air supply efficiency of the fan assembly.

Furthermore, on the basis of the first embodiment to the eighth embodiment, as shown in FIG. 1, the volute 102 includes a first housing 118 and a second housing 120 connected to each other. The first housing 118 is provided with the flow diffusion part 108 and the flow-passing part 110. In some embodiments, the first housing 118 is a lower housing of the volute 102, and the second housing 120 is an upper housing of the volute 102. The first housing 118 is provided with the volute tongue 112, and the volute tongue 112 is provided with the flow diffusion part 108 and the flow-passing part 110.

A ninth embodiment of the present disclosure provides an air conditioner. The air conditioner includes the fan assembly of any one of the first embodiment to the eighth embodiment.

The air conditioner of this embodiment includes the fan assembly according to any one of the above embodiments. Therefore, the air conditioner has all the beneficial effects of the above fan assembly and will not be repeated here.

As shown in FIG. 1, FIG. 2, FIG. 3 and FIG. 4, an embodiment of the present disclosure provides a fan assembly including the volute 102 and the fan wheel. In this embodiment, the shape of the volute 102 is optimized, and the volute tongue 112 includes the flow-passing part 110 and the flow diffusion part 108 that are used cooperatively, enabling that the flow-passing part 110 is located at the higher position than the flow diffusion part 108 to enable the relative position of the flow diffusion part 108 to be lower. In this way, the flow-passing area of the flow-passing part 110 at the volute tongue 112 can be effectively enlarged, and the airflow speed at the position where the flow-passing part 110 is located can be further reduced, which allows the overall flow speed of the fan assembly to be relatively uniform.

Further, in this embodiment as shown in FIG. 5, the volute tongue 112 further includes the tongue body 106, and the tongue body 106 is connected at the opening of the volute body 104. Each of the flow diffusion part 108 and the flow-passing part 110 is disposed at the tongue body 106. The flow-passing part 110 is disposed to be flushed with the inner wall of the tongue body 106, and the flow diffusion part 108 is recessed relative to the tongue body 106.

Further, in this embodiment, as shown in FIG. 4, the depth of the flow diffusion part 108 is optimized, which enables that the middle portion of the flow diffusion part 108 has the depth greater than the depth of each of the two side portions of the flow diffusion part 108 in the axial direction of the fan wheel. That is, the depth of the flow diffusion part 108 decreases gradually from the center to the two sides in the axial direction of the fan wheel, enabling that the flow diffusion effect of the flow diffusion part 108 decreases gradually in the axial direction of the fan wheel. In addition, the cross section of the flow diffusion part 108 in the axial direction of the fan wheel may include one arc or the plurality of arcs connected to one another, to ensure that the reference plane L1 is in the smooth state in the axial direction of the fan wheel. Furthermore, the cross section of the flow diffusion part 108 in the axial direction of the fan wheel is symmetrical with respect to the reference plane L1, ensuring that the shape of the flow diffusion part 108 matches the distribution of air volume. In addition, the height of the flow diffusion part 108 gradually increases in the air outflowing direction of the volute 102, ensuring that the airflow flows smoothly through the flow diffusion part 108 and that the airflow is in the smooth transition state when flowing through the flow diffusion part 108.

Further, in this embodiment, as shown in FIG. 7, after the air conditioner is mounted, the air outlet 124 of the volute 102 is disposed horizontally. When the cross section of the flow diffusion part 108 in the radial direction of the fan wheel includes the straight line, the first angle θ is formed between the straight line and the horizontal plane L2, and the first angle θ is greater than 8° and smaller than or equal to 12°. When the cross section of the flow diffusion part 108 in the radial direction of the fan wheel includes the arc, the second angle is formed between the tangent line of the arc at the end close to the fan wheel and the horizontal plane L2, and is greater than 8° and smaller than or equal to 12°.

Further, in this embodiment, the maximum depth H of the flow diffusion part 108 and the axial dimension L of the volute tongue 112 are optimized, to ensure that the ratio between the maximum depth H of the flow diffusion part 108 and the axial dimension L of the volute tongue 112 is greater than or equal to 0.05 and smaller than or equal to 0.1.

Further, in this embodiment as shown in FIG. 6, the volute tongue 112 further includes the sinking platforms 114, which are disposed at the flow-passing part 110 and located at the two sides of the flow diffusion part 108. In this way, the minimum gap between the inner wall of the volute 102 and the outer edge of the fan wheel can be ensured. Meanwhile, the impact of the airflow on the volute 102 is reduced and the flow field inside the volute 102 is optimized, to effectively prevent the vortex from being generated by the airflow at the volute tongue 112, which effectively reduces the vortex noise of the fan while ensuring the performance of the fan assembly. This in turn improves using comfort of the fan assembly and ensures the air supply efficiency of the fan assembly. In some embodiments, the sinking platforms 114 are arranged at the volute tongue 112, and the flow diffusion part 108 is located between the two sinking platforms 114.

Further, in this embodiment, as shown in FIG. 1, the air inlet 122 of the volute 102 is located at each of the two sides of the fan wheel in the axial direction. The air outlet 124 of the volute 102 is located at the lateral side of the fan wheel in the radial direction. In addition, the flow collector 116 is disposed at the air inlet 122 of the volute 102, and the flow collector 116 can achieve the good effect of collecting and guiding the flow at the air inlet 122 of the volute 102, thereby improving the air supply volume and the air supply efficiency of the fan assembly.

In some embodiments, the fan assembly is a core component of the air conditioner. The performance of the fan assembly determines the size, performance, and sound quality of the air conditioner. At present, the air conditioner generally has large noise, large dimension, and poor heat exchange effect due to the technical restrictions on the fan assembly. The present disclosure provides the fan assembly, which can solve the technical problems of large noise, large dimension, and poor heat exchange effect of the air conditioner.

As shown in FIG. 1, FIG. 2, FIG. 3 and FIG. 4, the fan assembly of the present disclosure includes the volute 102, the fan wheel, the flow diffusion part 108, and the flow-passing part 110. The volute 102 includes the volute body 104 and the volute tongue 112 connected at the opening of the volute body 104. As shown in FIG. 4, the volute tongue 112 includes the flow diffusion part 108 and the flow-passing part 110 in cooperation with each other. The flow diffusion part 108 is in a recessed state and lower than the flow-passing part 110, in which a recessed direction is directed to the outside of the volute tongue 112. In addition, as shown in FIG. 4, the plane having equal distances from two end surfaces of the fan wheel in the axial direction is defined as the reference plane L1. The cross section of the flow diffusion part 108 in the axial direction of the fan wheel is symmetrical with respect to the reference plane L1. In addition, when the cross section of the flow diffusion part 108 in the radial direction of the fan wheel includes the straight line, as shown in FIG. 7, the first angle θ is formed between the straight line and the horizontal plane L2. The first angle θ is greater than 8° and smaller than or equal to 12°. When the cross section of the flow diffusion part 108 in the radial direction of the fan wheel includes the arc, the second angle is formed between the tangent line of the arc at the end close to the fan wheel and the horizontal plane L2, and is greater than 8° and smaller than or equal to 12°. Further, the ratio between the maximum depth H of the flow diffusion part 108 and the axial dimension L of the volute tongue 112 is greater than or equal to 0.05 and smaller than or equal to 0.1. Furthermore, the cross section of the flow diffusion part 108 in the axial direction of the fan wheel includes one arc, or includes the plurality of arcs connected to one another. In addition, in the air supply direction of the volute 102, the flow diffusion part 108 may be directly connected to the inner wall of the volute body 104, or a rounded corner may be formed between the flow diffusion part 108 and the inner wall of the volute body 104. As shown in FIG. 6, the sinking platforms 114 may be provided at the position where the flow-passing part 110 is located.

In the case of the same noise, the air conditioner including the fan assembly of the present disclosure can supply the larger air volume to satisfy the air adjustment in the larger space. Accordingly, in the case of the same air volume, the air conditioner including the fan assembly of the present disclosure has lower noise, and the comfort of the air conditioner can be effectively improved.

In the case of the same air volume, the air conditioner including the fan assembly of the present disclosure has a higher static pressure to overcome resistance in an air supply pipeline and reduces mounting components in the air conditioner. Accordingly, in the case of the same air volume, a surface of a heat exchanger applying the fan assembly of the present disclosure has a more uniform flow speed distribution.

In the case of the same noise and the same air volume, the air conditioner including the fan assembly of the present disclosure has a smaller volume, which can meet the lower cost or adapt to the more diversified mounting space requirements.

In the description of the present disclosure, the term "plurality" means two or more, unless otherwise specified defined. The orientation or the position indicated by terms such as "above" and "below" refer to the orientation or the position as shown in the drawings, and is only for the convenience of describing the present disclosure and simplifying the description, rather than indicating or implying that the pointed device or element must have a specific orientation, or be constructed and operated in a specific orientation, and therefore cannot be understood as limitation to the present disclosure. The terms such as "connect," "install," "fix" and the like should be understood in a broad sense. For example, it may be a fixed connection, a detachable connection, or connection as one piece; or a direct connection or indirect connection through an intermediate element. For those skilled in the art, the specific meaning of the above terms in the present disclosure can be understood according to specific circumstances.

In the description of the present disclosure, description of terms such as "an embodiment," "some embodiments" and "a specific embodiment" means that specific features, structures, materials, or characteristics described in conjunction with the embodiment or example are included in at least one embodiment or example of the present disclosure. In this specification, the schematic representations of the above terms do not necessarily refer to the same embodiment or example. Moreover, the described specific features, structures, materials or characteristics may be combined in any one or more embodiments or examples in a suitable manner.

While some embodiments of the present disclosure have been described above, the present disclosure is not limited to these embodiments. For those skilled in the art, various changes and variations can be made to the present disclosure. Any modification, equivalent substitution, improvement and the like, made within the spirit and principles of the present disclosure, shall fall within the scope of the present disclosure.

What is claimed is:

1. A fan assembly comprising:

a volute including a volute body and a volute tongue connected at an opening of the volute body; and a fan wheel arranged at least partially in the volute body; wherein:

the volute tongue includes a flow diffusion part, a flow-passing part, and a sinking platform;

the flow-passing part is located at two sides of the flow diffusion part in an axial direction of the fan wheel;

a top surface of the flow-passing part is higher than a top surface of the flow diffusion part; and the sinking platform is located at a side of the flow-passing part that is away from the flow diffusion part, and a top surface of the sinking platform is lower than the top surface of the flow-passing part.

2. The fan assembly according to claim 1, wherein the volute tongue further includes a tongue body, the flow diffusion part and the flow-passing part being disposed at the tongue body, and the flow diffusion part being recessed relative to the tongue body.

3. The fan assembly according to claim 2, wherein in the axial direction of the fan wheel, a middle portion of the flow diffusion part has a depth greater than a depth of each of two side portions of the flow diffusion part.

4. The fan assembly according to claim 3, wherein a cross section of the flow diffusion part in the axial direction of the fan wheel includes one arc or a plurality of arcs connected to one another.

5. The fan assembly according to claim 2, wherein a height of the flow diffusion part gradually increases in an air outflowing direction of the volute.

6. The fan assembly according to claim 5, wherein a cross section of the flow diffusion part in a radial direction of the fan wheel includes a straight line, an angle between the straight line and a horizontal plane being greater than 8° and smaller than or equal to 12°.

7. The fan assembly according to claim 5, wherein a cross section of the flow diffusion part in a radial direction of the fan wheel includes an arc, an angle between a tangent line of the arc at an end close to the fan wheel and a horizontal plane being greater than 8° and smaller than or equal to 12°.

8. The fan assembly according to claim 5, wherein the flow diffusion part is connected to an inner wall of the volute body in a radial direction of the fan wheel.

9. The fan assembly according to claim 5, wherein a rounded corner is formed between the flow diffusion part and an inner wall of the volute body in a radial direction of the fan wheel.

10. The fan assembly according to claim 2, wherein a ratio of a maximum depth of the flow diffusion part to an axial dimension of the volute tongue is greater than or equal to 0.05 and smaller than or equal to 0.1.

11. The fan assembly according to claim 1, wherein the sinking platform is located at the two sides of the flow diffusion part.

12. The fan assembly according to claim 1, wherein the volute has an air inlet located at one side of the fan wheel in the axial direction of the fan wheel;

the fan assembly further comprising:

a flow collector disposed at the air inlet.

13. The fan assembly according to claim 1, wherein the volute has two air inlets located at two sides of the fan wheel, respectively, in the axial direction of the fan wheel;

the fan assembly further comprising:

two flow collectors each disposed at one of the two air inlets.

14. An air conditioner comprising a fan assembly including:

a volute including a volute body and a volute tongue connected at an opening of the volute body; and a fan wheel arranged at least partially in the volute body, wherein:

the volute tongue includes a flow diffusion part, a flow-passing part, and a sinking platform;

the flow-passing part is located at two sides of the flow diffusion part in an axial direction of the fan wheel;

a top surface of the flow-passing part is higher than a top surface of the flow diffusion part; and the sinking platform is located at a side of the flow-passing part that is away from the flow diffusion part, and a top surface of the sinking platform is lower than the top surface of the flow-passing part.

15. The air conditioner according to claim 14, wherein the volute tongue further includes a tongue body, the flow diffusion part and the flow-passing part being disposed at the tongue body, and the flow diffusion part being recessed relative to the tongue body.

16. The air conditioner according to claim 15, wherein in the axial direction of the fan wheel, a middle portion of the flow diffusion part has a depth greater than a depth of each of two side portions of the flow diffusion part.

17. The air conditioner according to claim 16, wherein a cross section of the flow diffusion part in the axial direction of the fan wheel includes one arc or a plurality of arcs connected to one another.

18. The air conditioner according to claim 15, wherein a height of the flow diffusion part gradually increases in an air outflowing direction of the volute.

19. The air conditioner according to claim 18, wherein a cross section of the flow diffusion part in a radial direction of the fan wheel includes a straight line, an angle between the straight line and a horizontal plane being greater than 8° and smaller than or equal to 12°.

20. The air conditioner according to claim 18, wherein a cross section of the flow diffusion part in a radial direction of the fan wheel includes an arc, an angle between a tangent line of the arc at an end close to the fan wheel and a horizontal plane being greater than 8° and smaller than or equal to 12°.

* * * * *